US005531234A

United States Patent [19]

Inomata et al.

[11] Patent Number: 5,531,234

[45] Date of Patent: Jul. 2, 1996

[54] APPARATUS FOR CONTROLLING THE FILLING AMOUNT OF SHREDDED TOBACCO IN CIGARETTES

[75] Inventors: Shigemitsu Inomata; Mikio Komori, both of Tokyo, Japan

[73] Assignee: Japan Tobacco Inc., Tokyo, Japan

[21] Appl. No.: 355,215

[22] Filed: Dec. 8, 1994

Related U.S. Application Data

[63] Continuation of Ser. No. 259,129, Jun. 13, 1994, abandoned, which is a continuation of Ser. No. 19,284, Feb. 18, 1993, abandoned.

[30] Foreign Application Priority Data

Feb. 18, 1992 [JP] Japan ..... 4-030689
Feb. 18, 1992 [JP] Japan ..... 4-030690

[51] Int. Cl.[6] ..... A24C 5/14; A24C 5/18; A24C 5/28

[52] U.S. Cl. ..... 131/84.1; 131/84.4; 131/108; 131/906

[58] Field of Search ..... 131/108, 84.1, 131/84.4, 906; 198/959; 364/560, 561, 562, 567, 569, 575

[56] References Cited

U.S. PATENT DOCUMENTS

| | | | |
|---|---|---|---|
| 3,593,997 | 7/1971 | Boehner | 273/26 |
| 3,662,272 | 5/1972 | Bolt . | |
| 3,738,376 | 6/1973 | Labbe et al. | 131/84.4 |
| 3,754,126 | 8/1973 | Williams, Jr. | 364/567 |
| 3,980,304 | 9/1976 | O'Neill et al. | 273/26 R |
| 4,014,352 | 3/1977 | Jamieson . | |
| 4,074,905 | 2/1978 | High | 273/26 D |
| 4,729,442 | 3/1988 | Sichet | 198/959 X |
| 4,815,736 | 3/1989 | Wright | 273/26 A |
| 4,890,834 | 1/1990 | Ponza | 273/26 R |
| 4,969,651 | 11/1990 | Comartin | 273/410 |
| 5,056,782 | 10/1991 | Giovagnoli | 273/26 R |
| 5,178,384 | 1/1993 | Gorman | 273/26 A |

FOREIGN PATENT DOCUMENTS

| | | | |
|---|---|---|---|
| 0032399 | 7/1981 | European Pat. Off. . | |
| 56-51977 | 5/1981 | Japan . | |
| 57-9353 | 2/1982 | Japan . | |
| 2128466 | 5/1984 | United Kingdom | 131/84.4 |
| 2133967 | 8/1984 | United Kingdom . | |
| 2134367 | 8/1984 | United Kingdom | 131/84.4 |
| 2137473 | 3/1985 | United Kingdom . | |

*Primary Examiner*—Jennifer Bahr

[57] ABSTRACT

A control apparatus for a cigarette production machine according to the present invention comprises a density sensor for detecting the filling density of shredded tobacco in a continuously formed tobacco rod, an integrator for integrating the output of the density sensor for a predetermined period of time, an arithmetic device for calculating the unit filling (filling amount of the shredded tobacco corresponding to a predetermined length of the tobacco rod) on the basis of an integral value from the integrator, multiplication-type D/A converter for supplying the integrator with an integral gain proportional to the rod speed of the cigarette production machine, and a trimming device for controlling the feed of the shredded tobacco onto a cigarette paper in accordance with the unit filling calculated by means of the arithmetic device.

18 Claims, 7 Drawing Sheets

APPARATUS FOR CONTROLLING THE FILLING AMOUNT OF SHREDDED TOBACCO IN CIGARETTES

This application is a continuation of application Ser. No. 08/259,129 filed on Jun. 13, 1994, now abandoned; which was a continuation of application Ser. No. 08/019,284 filed on Feb. 18, 1993, now abandoned.

BACKGROUND OF THE INVENTION

1. Field of the Invention

The present invention relates to an apparatus for controlling the filling amount of shredded tobacco in cigarettes so that the filling amount is fixed during the production the cigarettes.

2. Description of the Art

According to a cigarette production machine, shredded tobacco is fed onto a cigarette paper which travels in one direction. As the cigarette paper travels, the shredded tobacco is continuously wrapped in the paper, whereby a tobacco rod is formed. Thereafter, the tobacco rod is cut into individual cigarettes each having a predetermined length.

In order to improve the quality of the cigarettes as products, the filling amount of the shredded tobacco in each cigarette should be fixed in the first place. Accordingly, the cigarette production machine is provided with a control apparatus for controlling the filling amount of the shredded tobacco so that it is fixed. An example of this control apparatus is disclosed in Published Examined Japanese Patent Application No. 57-9353.

This conventional control apparatus includes a radiation-type density sensor, which continuously detects the filling amount of the shredded tobacco in the tobacco rod. In the control apparatus, an output from the density sensor is integrated for a given period of time by means of an integrator circuit, and the resulting integral value indicates the filling amount of the shredded tobacco corresponding to a predetermined length of the tobacco rod or a predetermined number of cigarettes.

Then, the control apparatus compares the calculated filling amount of the shredded tobacco with a reference value, and outputs a control signal which corresponds to the difference between the two values. This control signal is supplied to an adjusting device for adjusting the feed of the shredded tobacco onto the cigarette paper, thereby controlling the operation of the adjusting device. If the calculated filling amount of the shredded tobacco is smaller than the reference value, the adjusting device increases the feed of the shredded tobacco onto the paper. If the calculated filling amount of the shredded tobacco is greater than the reference value, on the other hand, the adjusting device reduces the tobacco feed. In this manner, the filling amount of the shredded tobacco for the predetermined length of the tobacco rod, that is, the filling amount of the shredded tobacco in the individual cigarettes, can be kept fixed.

Thus, the above-described control apparatus constitutes a section of the cigarette production machine which is essential to the stabilization of the cigarette quality.

As seen from the above description, the control apparatus computes the filling amount of the shredded tobacco corresponding to the predetermined number of cigarettes on the assumption that the length of the cigarettes, as well as the producing speed of the tobacco rod in the cigarette production machine, is fixed. Thus, the production machine is designed so as to produce fixed-length cigarettes at a constant speed. More specifically, a rod speed, which is represented by the product of the cigarette length and the rotational speed of the main shaft of the production machine, which determines the traveling speed of the cigarette paper or the tobacco rod, is constant.

Thus, the rod speed changes when manufacturing cigarettes of different lengths by means of one and the same cigarette production machine, or in the case where the rotational speed of the main shaft is changed to adjust the cigarette production. If the rod speed changes in this manner, the control apparatus cannot accurately compute the filling amount of the shredded tobacco to the predetermined number of cigarettes, and hence, cannot keep the filling amount of the shredded tobacco of each cigarette fixed.

If the rod speed is changed, therefore, the integrator circuit of the control apparatus requires adjustment. Entailing replacement of circuit elements, however, this adjustment cannot be made with ease.

Meanwhile, the rod speed cannot be constant during period between the reception of a starting signal by the cigarette production machine and the attainment of a given value by the rotating speed of the main shaft, or a period between the reception of an operation stop signal by the production machine and the full stoppage of the rotation of the main shaft.

Accordingly, the filling amount of the shredded tobacco cannot be accurately controlled with respect to the tobacco rod or cigarettes produced during those periods. Thus, these cigarettes are rejectable products which are excluded from management. If the rod speed of the cigarette production machine becomes higher, then the aforesaid periods are inevitably lengthened in proportion, so that the rejectable products increase.

SUMMARY OF THE INVENTION

The object of the present invention is to provide a control apparatus for a cigarette production machine, capable of easily coping with a change of the rod speed in the cigarette production machine and reducing the production of rejectable cigarettes which are excluded from management.

The above object is achieved by a control apparatus for a cigarette production machine according to the present invention. The control apparatus comprises: detecting means for detecting the filling density of shredded tobacco in a continuously formed tobacco rod and successively outputting detection signals; measuring means for calculating the unit filling of the shredded tobacco corresponding to a predetermined length of the tobacco rod in accordance with the output of the detecting means and outputting the result of the calculation, the measuring means including integrating means for integrating the output of the detecting means for a predetermined period of time and outputting an integral value, varying means for increasing or decreasing the output value from the integrating means in accordance with a rod speed, and arithmetic means for calculating the unit filling on the basis of the output value from the integrating means; and adjusting means for adjusting the feed of the shredded tobacco onto a cigarette paper in accordance with the result of the calculation by the measuring means.

According to the control apparatus described above, the filling density of the shredded tobacco in the traveling tobacco rod is continuously detected by the detecting means, and the output from the detecting means is integrated for the predetermined period of time by the integrating means. The integral value calculated by the integrating means is supplied to the arithmetic means, whereupon the arithmetic means calculates the unit filling of the shredded tobacco on the basis of the integral value.

The integral value obtained by means of the integrating means is increased or decreased in accordance with the rod speed by means of the varying means, so that the unit filling calculated on the basis of the integral value is equivalent to the filling amount of the shredded tobacco corresponding to the predetermined length of the formed tobacco rod or a predetermined number of cigarettes.

Thereafter, the adjusting means adjusts the feed of the shredded tobacco onto the cigarette paper in accordance with the calculated unit filling. Thus, the filling amount of the shredded tobacco in each cigarette to be produced can be securely set within an allowable range, so that the quality of the cigarettes can be improved.

In the case where the rotating speed of the main shaft of the cigarette production machine is changed in stages, or where the length of the cigarettes to be produced is changed, the varying means may include a gain switching device for supplying the integrating means with an integral gain corresponding to the rod speed. If the rod speed is changed, in this case, the integral gain of the integrating means can be properly varied in accordance with the rod speed through the switching operation of the switching device only. Thus, in this case, the unit filling of the tobacco rod formed can be accurately calculated, so that the control of the unit filling is effective.

The varying means may include gain supply means for supplying the integrating means with an integral gain corresponding to the change of the rotating speed of the main shaft. In this case, the gain supply means increases or decreases the integral gain in accordance with the rotating speed of the main shaft during a preparatory period before the a steady-state rotational speed is attained by the main shaft after a starting signal is received by the cigarette production machine, or during a stopping period before the rotation of the main shaft is fully stopped after an operation stop signal is received by the production machine. Also in this case, therefore, the unit filling of the tobacco rod formed can be accurately calculated, so that the control of the unit filling is effective. Thus, the filling amount of the shredded tobacco is highly accurately controlled also for those cigarettes which are produced during the preparatory and stopping periods, so that all the cigarettes produced can be shipped as products.

BRIEF DESCRIPTION OF THE DRAWINGS

The present invention, together with its objects and advantages, will be more fully understood from the ensuing detailed description and the accompanying drawings, which are given by way of illustration only, and thus, are not limitative of the present invention, and wherein.

DESCRIPTION OF THE PREFERRED EMBODIMENTS

Figure 1:
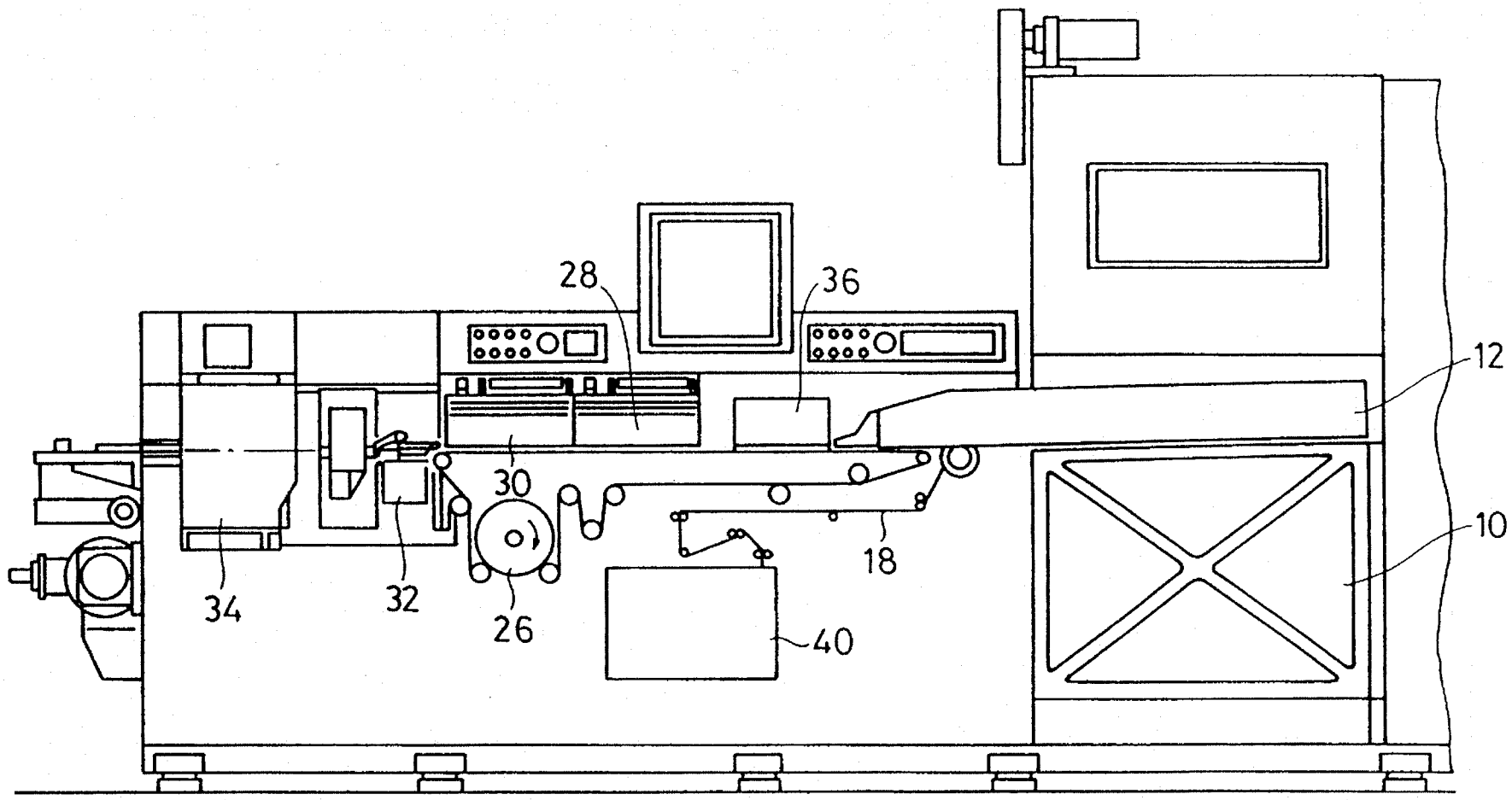
FIG. 1 is a front view illustrating a cigarette production machine.

A cigarette production machine shown in FIGS. 1 and 2, which is a conventional apparatus, will now be described in brief.

The cigarette production machine comprises a chimney 10, which is supplied with shredded tobacco T. The shredded tobacco T in the chimney 10 is sucked up toward a conveyor unit 12. The conveyor unit 12 contains a conveyor belt 14 having a number of small holes. Thus, the shredded tobacco T ascending in the chimney 10 is attracted to the lower surface of the conveyor belt 14. As the belt 14 travels, the attracted tobacco T is transported to the left of FIGS. 1 and 2.

In the process of transporting the shredded tobacco T described above, the stratified tobacco T attracted to the conveyor belt 14 is adjusted to a proper thickness by means of a trimming device 16 (see FIG. 2), and is then transferred from the belt 14 to the surface of a cigarette paper 18. Part of the paper 18 is lapped on an endless cloth belt 20. As the cloth belt 20 travels, therefore, the cigarette paper 18 is delivered from a paper roll (not shown), and travels together with the belt 20 in one direction.

The cloth belt 20 is passed around a number of rollers. That portion of the belt 20 which is situated between a pair of rollers 22 and 24 (FIG. 2), among the other rollers, passes through a wrapping section W. In this wrapping section W, the cloth belt 20 extends horizontally, and the cigarette paper 18 is lapped on a horizontal portion of the belt 20.

Further, the cloth belt 20 is passed around a driving drum 26, which is connected to a drive source (not shown). Thus, when the driving drum 26 is rotated in one direction by means of the drive source, the cloth belt 20 travels together with the cigarette paper 18 in the direction indicated by the arrow in FIG. 2.

A rod forming device 36 (see FIG. 1) is located on the upper-course side of the wrapping section W with respect to the traveling direction of the cloth belt 20 or the cigarette paper 18. When the paper 18, along with the cloth belt 20, travels past the forming device 36, the paper 18 and the belt 20 are curved in the form of a rod filled with the shredded tobacco T on the paper 18. At this time, the opposite side edges of the cigarette paper 18 are lapped on and bonded to each other, whereby a tobacco rod R is formed. To attain this, the forming device 36 includes a paste applicator and an adjuster, as well as upper and lower molds for forming the tobacco rod R. The paste applicator is used to apply paste to one side edge of the paper 18, in order to bond the opposite side edges of the paper. The adjuster serves to adjust the diameter of the tobacco rod R to be formed.

Thus, the tobacco rod R is continuously delivered from the forming device 36, and the speed of its production corresponds to the traveling speed of the cigarette paper 18 or the cloth belt 20.

In the wrapping section W, dryers 28 and 30 (see FIG. 1) are successively arranged on the lower-course side of the forming device 36. As the tobacco rod R travels past these dryers 28 and 30, the paste on the cigarette paper 18 is dried by the dryers, whereby the opposite side edges of the paper 18 are securely bonded together.

The dried tobacco rod R is delivered from the wrapping section W, and is then passed through a density sensor 32. The sensor 32 detects the filling density of the shredded tobacco T in the passing tobacco rod R, and successively delivers detection signals. The construction of this density sensor 32 is described in Published Examined Japanese Patent Application No. 57-9353 mentioned before.

As the tobacco rod R travels past a cutting device 34, thereafter, it is cut into pieces or cigarettes each having a predetermined length.

Figure 2:
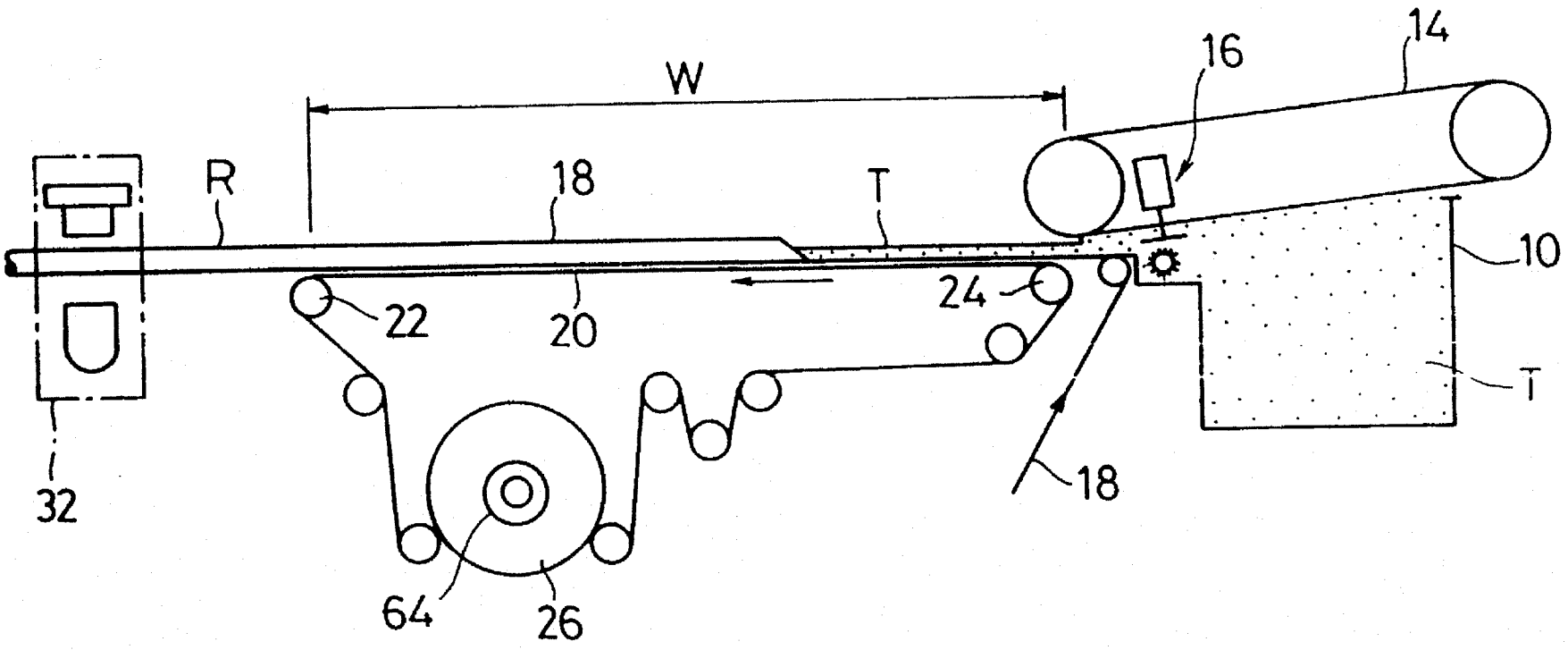
FIG. 2 is a schematic view illustrating the operative function of the cigarette production machine of FIG. 1.

As shown in FIG. 1, the cigarette paper 18 delivered from the paper roll is fed to the wrapping section W via a printing device 40. When necessary, the printing device 40 prints on the paper 18 a mark indicative of the brand of the cigarettes, the machine number of the cigarette production machine, etc.

Figure 3:
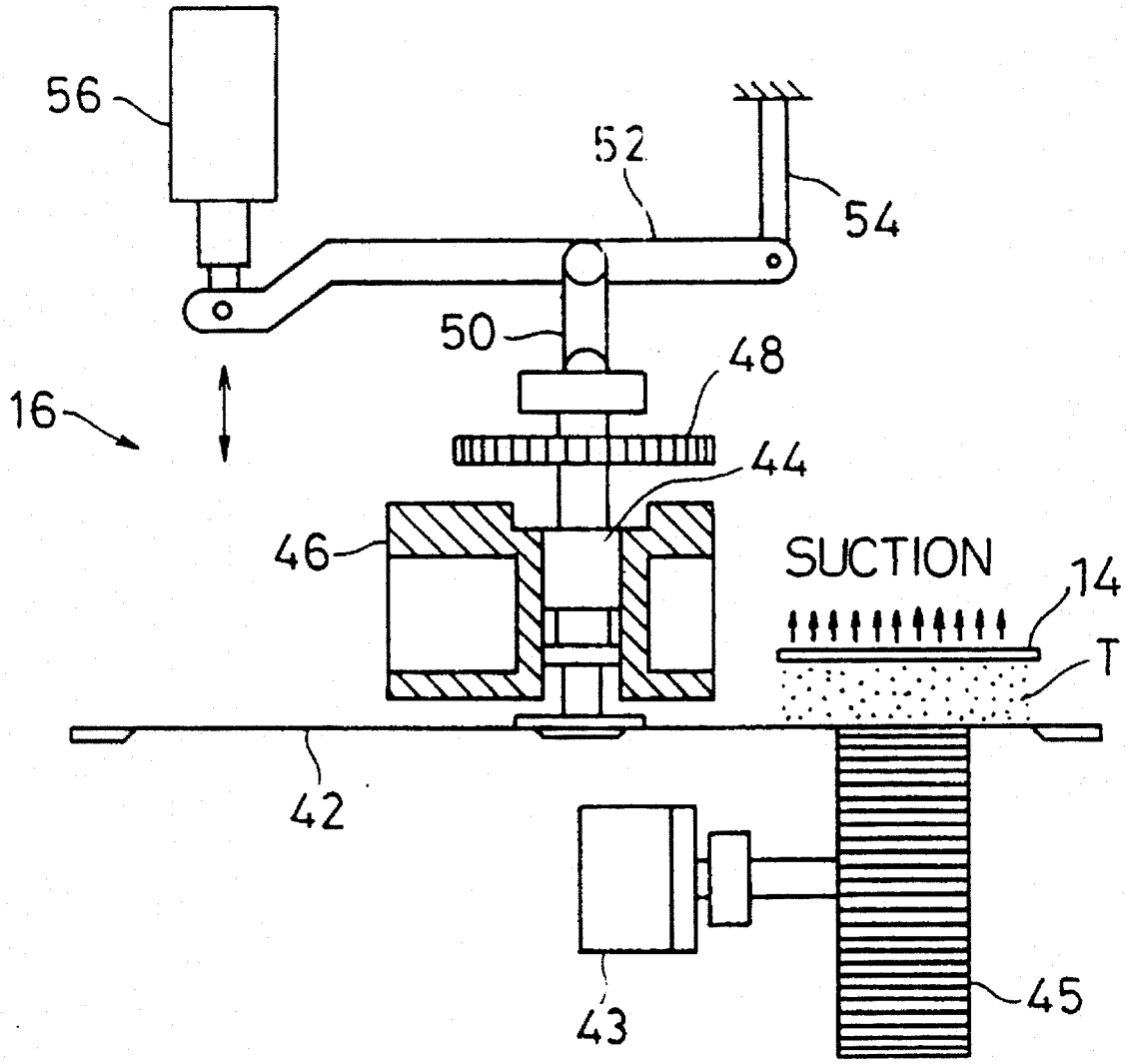
FIG. 3 is a detailed view illustrating a trimming device shown in FIG. 2.

Referring now to FIG. 3, there is specifically show the trimming device 16.

The trimming device 16 is provided with a trimming disk 42, which is arranged so that its peripheral edge portion is situated under the conveyor belt 14. A rotating shaft 44 of the disk 42 extends upward so as to penetrate a guide 46 for ascent and descent. A driving gear 48 is mounted on the upper end portion of the shaft 44. Thus, when a driving force from an electric motor (not shown) is transmitted to the gear 48, the trimming disk 42 is rotated at high speed.

The upper end of the rotating shaft 44 is connected to a link arm 52 by means of a connecting member 50. One end of the arm 52 is connected to the lower end of a support rod 54, and the other end to a hydraulic servomotor 56. When the motor 56 is driven, it causes the other end of the link arm 52 to move up and down. Thus, the link arm 52 rocks around the one end thereof, so that the trimming disk 42 is also moved up and down by means of the rotating shaft 44.

When the level of the trimming disk 42, that is, the distance between the disk 42 and the conveyor belt 14, is adjusted as the disk 42 moves up and down, the amount of the shredded tobacco T removed from the belt 14 by the high-speed rotation of the disk 42 changes. Accordingly, the thickness of a layer of the shredded tobacco T attracted to the conveyor belt 14 is determined by the level of the trimming disk 42. In this manner, the feed of the shredded tobacco T from the belt 14 onto the cigarette paper 18 can be adjusted.

A brush 45 is located under the trimming disk 42. The brush 45 scrapes off surplus shredded tobacco from the conveyor belt 14 as it is rotated by means of the motor 43.

Figure 4:
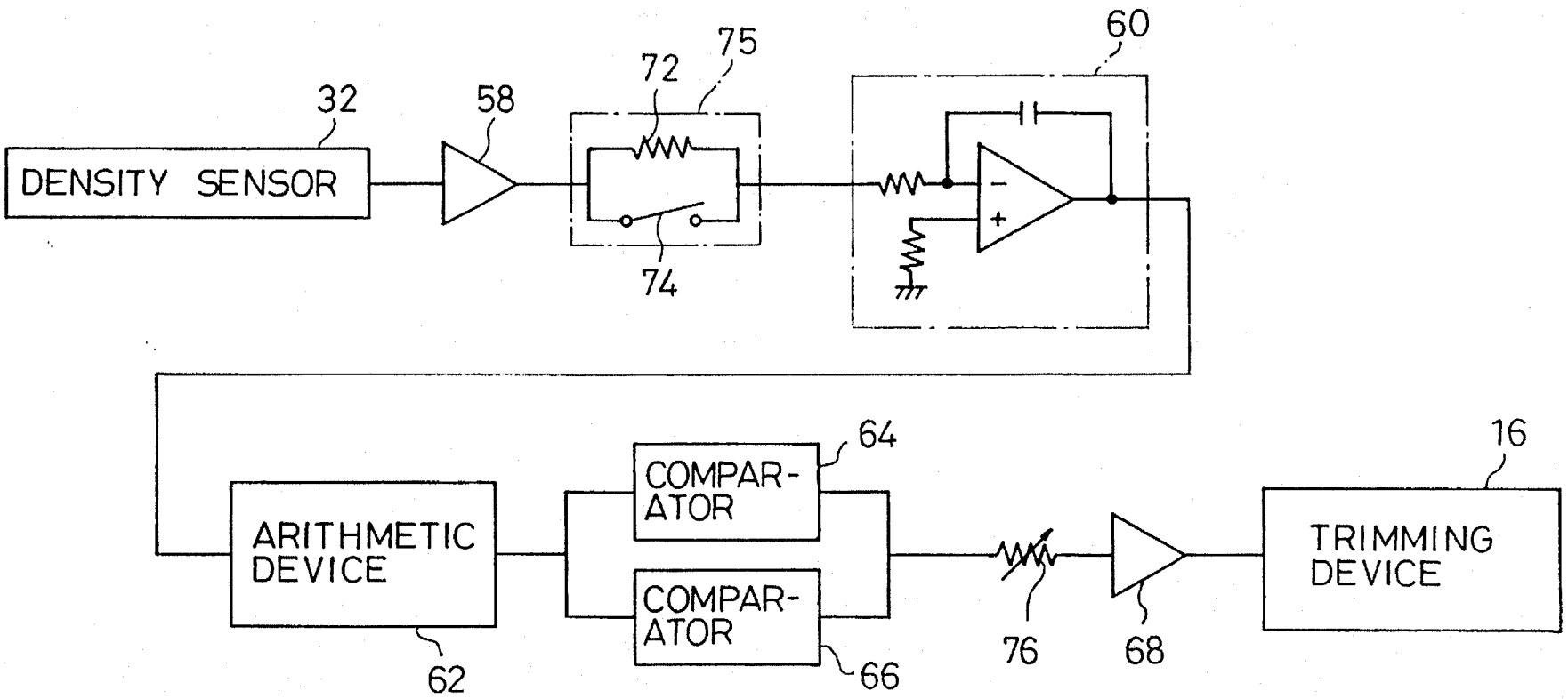
FIG. 4 is a diagram illustrating a filling control circuit according to a first embodiment.

Referring now to FIG. 4, there is shown a control circuit for controlling the trimming device 16 in accordance with the output from the density sensor 32.

This control circuit comprises an integrator 60 which receives the output from the density sensor 32 through an amplifier 58. The integrator 60 includes an operational amplifier, whose negative input terminal is connected electrically to the sensor 32 through the amplifier 58. Thus, the integrator 60 integrates the output of the density sensor 32 for a given period of time, and supplies an integral value to an arithmetic device 62. Based on the integral value from the integrator 60, the arithmetic device 62 calculates the filling amount of the shredded tobacco T for a predetermined length of the tobacco rod R, that is, a unit filling. The unit filling is equivalent to the filling amount of the shredded tobacco for each predetermined number of cigarettes.

Then, the calculated unit filling is supplied to each of comparators 64 and 66. The one comparator 64 compares the unit filling with a predetermined upper limit value. If the unit filling is greater than the upper limit value, the comparator 64 outputs a positive control signal which corresponds to the difference between the two values.

The other comparator 66 compares the unit filling with a predetermined lower limit value. If the unit filling is smaller than the lower limit value, the comparator 66 outputs a negative control signal which corresponds to the difference between the two values.

The control signal delivered from one of the comparators 64 and 66 is amplified by means of an amplifier 68, and is then supplied to the trimming device 16 or the hydraulic servomotor 56. In response to the control signal, the servomotor 56 varies the level of the trimming disk 42, and adjusts the feed of the shredded tobacco T onto the cigarette paper 18, as mentioned before.

More specifically, when the hydraulic servomotor 56 is supplied with the positive control signal, it raises the level of the trimming disk 42, depending on the value of the positive control signal, thereby reducing the feed of the shredded tobacco T onto the cigarette paper 18 or the unit filling.

When the hydraulic servomotor 56 is supplied with the negative control signal, on the other hand, it lowers the level of the trimming disk 42, depending on the value of the negative control signal, thereby increasing the feed of the shredded tobacco T onto the cigarette paper 18 or the unit filling.

This unit filling control is executed on the assumption that a rod speed, which is represented by the product of the rotational speed of the main shaft of the cigarette production machine or the driving drum 26 and the length of the cigarettes to be produced, is constant.

The control circuit may be used in a cigarette production machine which is constructed so that the rotating speed of the driving drum 26, that is, the rod speed, can be varied in two stages, in order to adjust the production of the cigarettes. In this case, the control circuit is provided with a gain switching device 75 which is interposed between the amplifier 58 and the integrator 60.

The gain switching device 75 comprises a resistor 72, having a predetermined resistance value and connected between the amplifier 58 and the integrator 60 in series therewith, and a changeover switch 74 connected across the resistor 72 in parallel therewith.

With use of the gain switching device 75 in the control circuit, the integral gain of the integrator 60 can be easily switched by only opening or closing the changeover switch 74. More specifically, when the rotating speed of the driving drum 26 or the rod speed is shifted to the low-speed side, the switch 74 is opened, so that the integral gain of the integrator 60 is set to a small value.

If the integral gain of the integrator 60 is changed in accordance with the rod speed, as mentioned before, the unit filling calculated by means of the arithmetic device 62 takes a value corresponding to the same number of cigarettes on the basis of the output of the integrator 60 without regard to the variation of the rod speed.

Thus, the feed of the shredded tobacco T onto the cigarette paper 18 can be controlled highly accurately by regulating the level of the trimming disk 42 in accordance with the unit filling calculated by means of the arithmetic device 62. In this manner, the filling amount of the shredded tobacco T in each individual cigarette can be accurately restricted within a given range.

The control circuit of FIG. 4 includes a variable resistor 76 which is interposed between the amplifier 68 and the comparators 64 and 66. The resistor 76 adjusts the operating speed of the hydraulic servomotor 56 as the rod speed changes.

Figure 5:
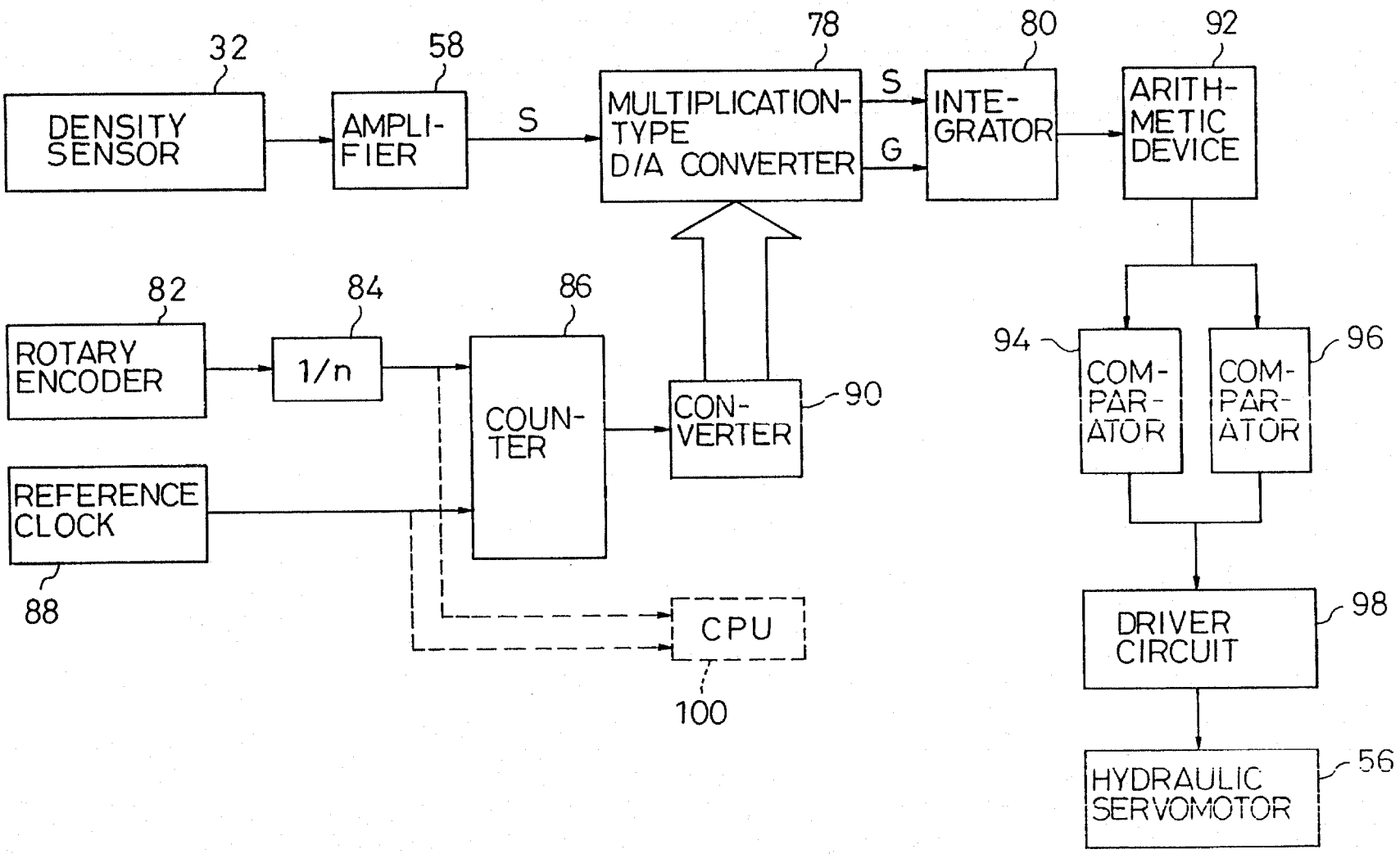
FIG. 5 is a diagram illustrating a filling control circuit according to a second embodiment.

Referring now to FIG. 5, there is shown a second embodiment of the control circuit. The control circuit of FIG. 5 comprises a multiplication-type D/A (digital-to-analog) converter 78 with a buffer which receives an output S from the density sensor 32 through the amplifier 58. More specifically, the D/A converter 78 (AD7524 from Analog Device Co., Ltd.) has input and output terminals through which the output S from the density sensor 32 is supplied directly to an integrator 80. The integrator 80, like the integrator 60, includes an operational amplifier.

The control circuit further comprises a rotary encoder 82. The encoder 82, which is mounted on the rotating shaft of the driving drum 26, outputs pulse signals corresponding to the rotating speed of the drum 26.

The pulse signals from the rotary encoder 82 are supplied to a counter 86 through a frequency divider 84. The divider 84 reduces the number of pulse signals supplied from the encoder 82 to the counter 86 per unit time to 1/n.

Further, the counter 86 is supplied with reference pulse signals from a reference clock 88. The counter 86 counts the pulse signals supplied from the rotary encoder 82 during the pulse interval of the reference pulse signals, and supplies the resulting count value in the form of a serial signal to a converter 90.

The count value from the counter 86 is indicative of the rotating speed of the driving drum 26 or the traveling speed of the cloth belt 20. The traveling speed of the cloth belt 20 corresponds to the speed of production of the tobacco rod R. If the length of the cigarettes is fixed, therefore, the output from the counter 86 is identical with the rod speed.

The converter 90 converts the serial signal from the counter 86, which is indicative of the rod speed, into an 8-bit parallel signal, and supplies the resulting signal to an input port of the D/A converter 78.

Based on the supplied parallel signal, the D/A converter 78 calculates an integral gain G which corresponds to the rod speed, and supplies the gain G to the integrator 80.

More specifically, when the D/A converter 78, which has a reference voltage, is supplied with the parallel signal, it outputs, as the integral gain, a voltage value obtained by multiplying the value of the reference voltage by the reciprocal of the value represented by the parallel signal. Thus, the output voltage or integral gain from the D/A converter 78 is proportional to the rod speed. Since the parallel signal is given in 8 bits, as mentioned before, the integral gain can take 256 values.

The integrator 80 integrates the output supplied thereto from the density sensor 32 through the D/A converter 78 for a predetermined period of time on the basis of the integral gain given from the converter 78, and supplies the resulting integral value to an arithmetic device 92. The arithmetic device 92, like the arithmetic device 62, calculates the unit filling of the tobacco rod R on the basis of the integral value.

Figure 6:
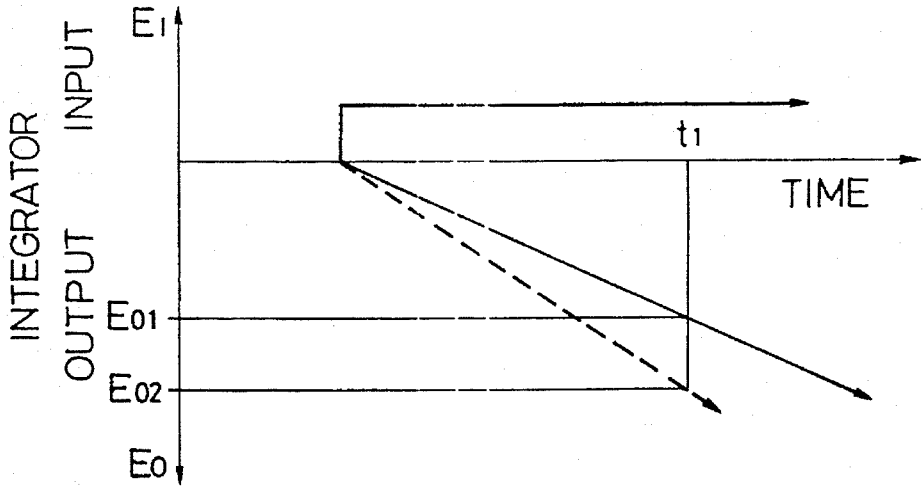
FIG. 6 is a graph showing the relationship between the input and output of an integrator shown in FIG. 5.

Referring now to FIG. 6, there is shown the relationship between the input $E_I$ and output $E_O$ of the integrator 80. When the input $E_I$ changes in the form of a step, as shown in FIG. 6, for example, the output $E_O$ increases with the passage of time, as indicated by full line, depending on the value of the integral gain at this point of time. Thus, an output value $E_{O1}$ obtained after the passage of a measuring time $t_1$ indicates a variation per unit filling (the filling amount of the shredded tobacco for N number of cigarettes).

According to the control circuit of this second embodiment, however, the integral gain G of the integrator 80 is varied in accordance with the rod speed of the tobacco rod R, as mentioned later. If the rod speed changes ascendingly, for example, the integral gain G also increases correspondingly, and the output $E_O$ of the integrator 80 becomes greater than the value indicated by full line, as indicated by broken line in FIG. 6.

Thus, an output value $E_{O2}$ obtained after the passage of the measuring time $t_1$ indicates the variation per unit filling, so that the unit filling calculated by means of the arithmetic device 92 corresponds to the filling amount of the shredded tobacco for N number of cigarettes.

The output of the arithmetic device 92 or the unit filling is supplied to each of comparators 94 and 96. These comparators 94 and 96 have the same functions as their corresponding comparators 64 and 66. Thus, if the calculated unit filling is greater than an upper limit value, the comparator 94 outputs a positive control signal which corresponds to the difference between the two values. If the calculated unit filling is smaller than a lower limit value, on the other hand, the comparator 96 outputs a negative control signal which corresponds to the difference between the two values.

When the control signal is delivered from one of the comparators 94 and 96, it is supplied to the hydraulic servomotor 56 of the trimming device 16 through a driver circuit 98. Based on this control signal, the level of the trimming disk 42, that is, the feed of the shredded tobacco T onto the cigarette paper 18 is adjusted by means of the servomotor 56. As a result, the unit filling of the tobacco rod R to be formed can be securely controlled so that it is within the allowable range between the upper and lower limit values.

According to the control circuit of the second embodiment described above, the unit filling of the tobacco rod R can be highly accurately controlled immediately when the rotation of the driving drum 26 is started after a starting signal is supplied to the cigarette production machine.

Figure 7:
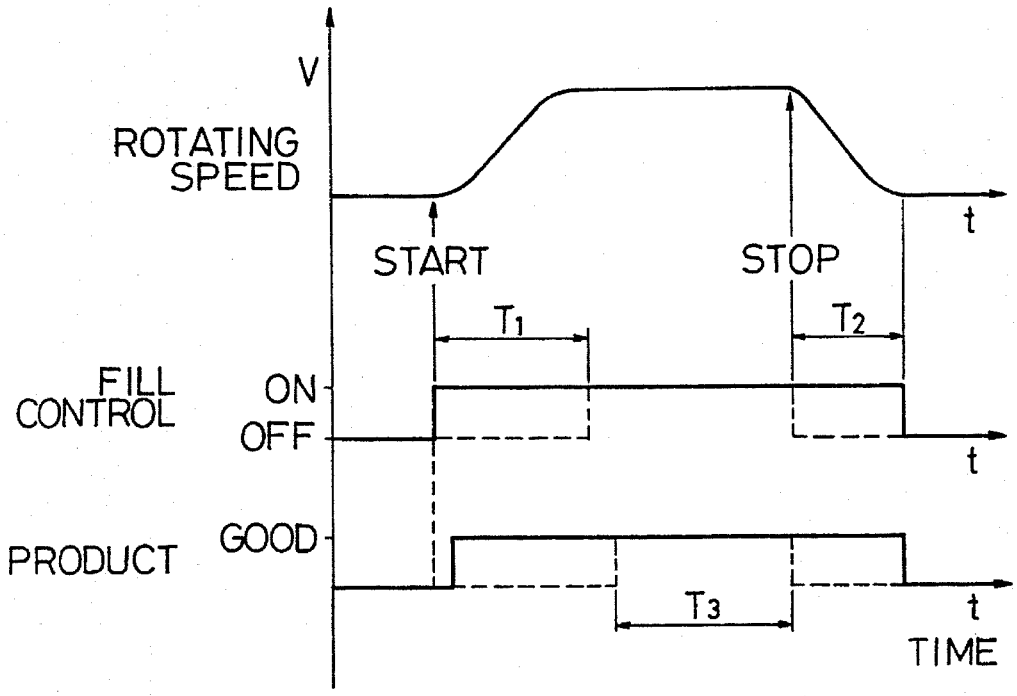
FIG. 7 is a graph showing a region in which the control circuit functions effectively.

More specifically, even when the rotation of the driving drum 26 is started after the supply of the starting signal to the cigarette production machine, the rotating speed of the drum 26 cannot immediately attain a given steady-state speed, that is, a predetermined preparatory period is required before the attainment of the steady-state speed, as shown in FIG. 7.

Even when an operation stop signal is supplied to the cigarette production machine, moreover, the rotation of the driving drum 26 cannot be stopped at once, that is, a predetermined stopping period is required before the drum 26 completely ceases to rotate.

During the aforesaid preparatory period, the rod speed of the cigarette production machine gradually increases to a steady-state rod speed. During the stopping period, on the other hand, the rod speed gradually lowers from the steady-state rod speed to zero. Thus, the rod speed continually changes during these periods.

Figure 8:
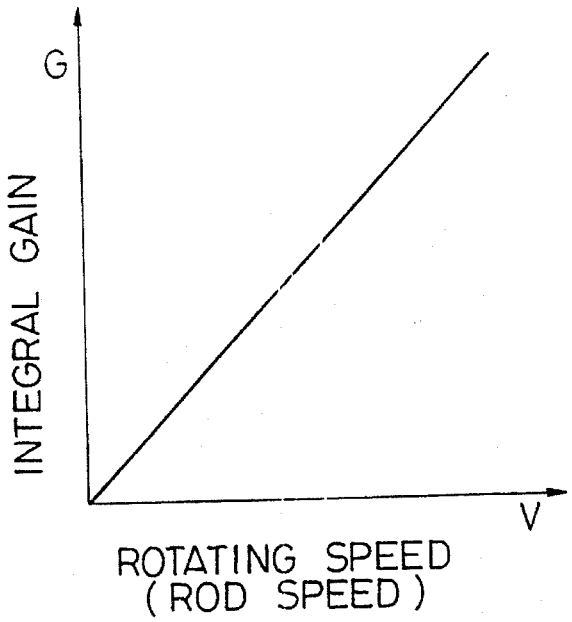
FIG. 8 is a graph showing the relationship between the rotating speed and integral gain of a driving drum.

In the case of the control circuit of the second embodiment, however, the integral gain G supplied to the integrator 80 during the preparatory and stopping periods increases or decreases as the rotating speed of the driving drum 26 or the rod speed varies, as shown in FIG. 8. Despite the change of the rod speed, therefore, the unit filling of the tobacco rod R, calculated by means of the arithmetic device 92 on the basis of the output of the integrator 80, takes an accurate value. Thus, the unit filling of the tobacco rod R can be securely set within the allowable range by controlling the feed of the shredded tobacco onto the cigarette paper 18 in accordance with the calculated unit filling during the preparatory and stopping periods.

In other words, according to the control circuit of the second embodiment, the control of the unit filling of the tobacco rod R is effective for the whole operational region, as shown in FIG. 7, so that all the cigarettes produced can be shipped as products.

In the case of the conventional cigarette production machine, however, the unit filling of the tobacco rod R cannot be accurately controlled with respect to the preparatory and stopping periods $T_1$ and $T_2$ during which the rod speed changes. Accordingly, those cigarettes which are produced during these periods are excluded from management, and cannot be shipped as products. In the case of the conventional production machine, moreover, deliverable products are those cigarettes which are produced during a period $T_3$ such that the rod speed is in the steady state, as shown in FIG. 7.

It is to be understood that the present invention is not limited to the embodiments described above, and that various changes and modifications may be effected therein by one skilled in the art without departing from the scope or spirit of the invention.

In each of the embodiments described above, for example, the rod speed changes depending on the rotating speed of the driving drum 26. However, the rod speed may also changes depending on the length of the cigarettes.

Thus, in the case where that cigarettes of different lengths are manufactured by means of one and the same cigarette production machine, or in the case where the rotating speed of the driving drum 26 is varied in three stages or more, it is necessary only that the gain switching device 75 in the control circuit of the first embodiment be previously provided with a plurality of resistors corresponding to different rod speeds and a changeover switch for selecting one of these resistors.

Figure 9:
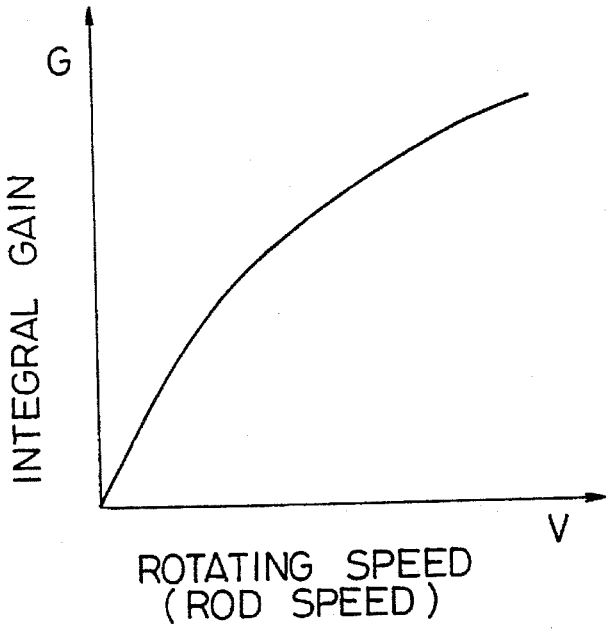
FIG. 9 is a graph showing a modification for setting the integral gain.

In the case of the control circuit of the second embodiment, the integral gain supplied to the integrator 80 linearly changes as the rod speed increases, as shown in FIG. 8. As indicated by broken line in FIG. 5, however, the counter 86 can be replaced with a microcomputer 100 which includes a central processing unit (CPU). In this case, the integral gain supplied from the D/A converter 78 to the integrator 80 can be varied along an optional curve as the rotating speed of the driving drum 26 changes, as shown in FIG. 9.

Also in the cigarette production machine provided with the control circuit of the second embodiment, a gain switching device, which corresponds to the length of each cigarette, may be interposed between the D/A converter 78 and the integrator 80 in the case where the cigarette length varied.

What is claimed is:

1. An apparatus for controlling the filling amount of shredded tobacco in tobacco rod continuously produced by wrapping the shredded tobacco in a cigarette paper, the tobacco rod having a rod speed, said apparatus comprising:

a feeder for feeding the shredded tobacco onto the cigarette paper;

detecting means for detecting a filling density of the shredded tobacco in the tobacco rod and successively outputting detection signals;

measuring means for calculating a unit filling of the shredded tobacco corresponding to a predetermined length of the tobacco rod in accordance with the output of said detecting means and outputting the result of the calculation, said measuring means including integrating means for integrating the output of said detecting means for a predetermined period of time and outputting an integral value, varying means for varying the internal value output from the integrating means in proportion to the rod speed, wherein the rod speed is defined by the traveling speed of cigarette paper and a length of a cigarette to be manufactured, and outputting a result, and arithmetic means for calculating the unit filling on the basis of the result from the varying means; and adjusting means for adjusting the feed of said feeder in accordance with the unit filling from the arithmetic means.

2. The apparatus according to claim 1, wherein said detecting means included a radiation-type density sensor.

3. The apparatus according to claim 1, wherein the varying means includes a switching device for supplying the integrating means with an integral gain which is proportional to the increasing or decreasing of the rod speed, and the integrating means includes an integrator for integrating the output of the density sensor in accordance with the supplied integral gain.

4. The apparatus according to claim 2, wherein the switching device includes a resistor, interposed between the density sensor and the integrator and adapted to vary the integral gain in accordance with the rod speed, and a switch connected across the resistor in parallel therewith.

5. The apparatus according to claim 1, wherein the varying means includes first means for detecting the rod speed and outputting the detection signal, and second means for supplying the integrating means with an integral gain corresponding to the detection signal for the first means, and the integrating means includes an integrator for integrating the output of the density sensor in accordance with the supplied integral gain.

6. The apparatus according to claim 5, wherein the first means includes a speed sensor for detecting a traveling speed of the cigarette paper.

7. The apparatus according to claim 5, wherein the speed sensor includes a rotary encoder for outputting pulse signals corresponding to the rotation of a rotating member which sets the traveling speed of the cigarette paper, a reference clock for generating clock pulse signals, and comparing means for receiving and comparing the pulse signals from the rotary encoder and the reference clock and outputting a serial speed signal corresponding to the rotating speed of the rotating member.

8. The apparatus according to claim 6, wherein the comparing means includes a counter for outputting a speed signal proportional to the rotating speed of the rotating member in the form of a serial signal, and the second means includes a converter for converting the speed signal from the counter into a parallel signal and an arithmetic unit for calculating an integral gain in accordance with the parallel signal from the converter, the integral gain being proportional to the rotating speed of the rotating member.

9. The apparatus according to claim 7, wherein the arithmetic unit includes a multiplication-type digital-to-analog converter.

10. The apparatus according to claim 1, wherein said feeder includes a chimney for supplying the shredded tobacco and a conveyor unit for conveying the shredded tobacco, the conveyor unit having a conveyor belt to which the shredded tobacco, is attracted and said adjusting means includes a trimming device for adjusting the thickness of the shredded tobacco attracted to the conveyor belt.

11. The apparatus according to claim 9, further comprising:

an endless belt for transporting the cigarette paper onto which the shredded tobacco is fed from the conveyor unit;

a forming device, into which said endless belt is passed, for forming the tobacco rod from the cigarette paper and the shredded tobacco by applying paste to one side edge cigarette paper and lapping the opposite side edges cigarette paper;

a cutting device, located downstream of said forming device with respect to movement of said endless belt, for cutting the tobacco rod into pieces each having a predetermined length; and a driving drum for driving the endless belt.

12. The apparatus according to claim 1, wherein said feeder includes a chimney for supplying the shredded tobacco and a conveyor unit for conveying the shredded tobacco, the conveyor unit to which the shredded tobacco is attracted, and said adjusting means includes a trimming device for adjusting the thickness of the shredded tobacco attracted to the conveyor belt.

13. The apparatus according to claim 2, further comprising:

an endless belt for transporting the cigarette paper onto which the shredded tobacco is fed from the conveyor unit;

a forming device, into which said endless belt is passed, for forming the tobacco rod from the cigarette paper and the shredded tobacco by applying paste to one side edge of the cigarette paper and lapping the opposite side edges of the cigarette paper;

a cutting device, located downstream of said forming device with respect to movement of said endless belt, for cutting the tobacco rod into pieces each having a predetermined length; and a driving drum for driving the endless belt.

14. The apparatus according to claim 4, wherein said feeder includes a chimney for supplying the shredded tobacco and a conveyor unit for conveying the shredded tobacco, the conveyor unit having a conveyor belt to which the shredded tobacco is attracted, and said adjusting means includes a trimming device for adjusting the thickness of the shredded tobacco attracted to the conveyor belt.

15. The apparatus according to claim 5, further comprising:

an endless belt for transporting the cigarette paper onto which the shredded tobacco is fed from the conveyor unit;

a forming device, into which said endless belt is passed, for forming the tobacco rod from the cigarette paper and the shredded tobacco by applying paste to one side edge of the cigarette paper and lapping the opposite side edges of the cigarette paper;

a cutting device, located downstream of said forming device with respect to movement of said endless belt, for cutting the tobacco rod into pieces each having a predetermined length; and a driving drum for driving the endless belt.

16. An apparatus for controlling the filling amount of shredded tobacco in tobacco rod continuously produced by wrapping the shredded tobacco in a cigarette paper, the tobacco rod having a rod speed, said apparatus comprising:

a feeder for feeding the shredded tobacco onto the cigarette paper;

a detecting device for detecting a filling of the shredded tobacco in the tobacco rod and successively outputting detection signals;

a measuring circuit for calculating a unit filling of the shredded tobacco corresponding to a predetermined length of the tobacco rod in accordance with the output of said detecting device and outputting the result of the calculation;

said measuring circuit including integrating means for integrating the output of said detecting device for a predetermined period of time on the basis of an integral gain and outputting an integral value, supplying means for supplying the integral means with an integral gain corresponding to an increase or decrease of the rod speed, and arithmetic means for calculating the unit filling on the basis of the output value from the integrating means; and adjusting means for adjusting the feed of said feeder in accordance with the unit filling from the arithmetic means.

17. An apparatus for controlling the filling amount of shredded tobacco in tobacco rod continuously produced by wrapping the shredded tobacco in a cigarette paper, the tobacco rod having a rod speed, said apparatus comprising:

a feeder for feeding the shredded tobacco onto the cigarette paper;

a first detecting device for detecting a filling of the shredded tobacco in the tobacco rod and successively outputting first detection signals;

a second detecting device for detecting the rod speed, said detecting device including a rotary encoder for outputting pulse signals corresponding to the rotation of a rotating member which sets a traveling speed of the cigarette paper, a reference clock for generating clock pulse signals, and comparing means for receiving and comparing the pulse signals from the rotary encoder and the reference clock and outputting a serial speed signal corresponding to the rotating speed of the rotating member;

a measuring circuit for calculating a unit filling of the shredded tobacco corresponding to a predetermined length of the tobacco rod in accordance with the output of the said first and second detecting devices and outputting the result of the calculation;

said measuring circuit including integrating means for integrating the output of said first detecting device for a predetermined period of time on the basis of an integral gain and outputting an integral value, supplying means for supplying the integrating means with an integral gain determined on the basis of the serial speed signal from said second detecting device, and arithmetic means for calculating the unit filling on the basis of the output value from the integrating means; and adjusting means for adjusting the feed of said feeder in accordance with the unit filling from the arithmetic means.

18. A method of making cigarettes, including the steps of:

(a) running cigarette paper in a first direction;

(b) feeding shredded tobacco onto the cigarette paper;

(c) forming a tobacco rod from the shredded tobacco and the cigarette paper;

(d) cutting the tobacco rod into pieces having a predetermined length;

(e) detecting the density of the shredded tobacco in the continuously formed tobacco rod and outputting detection signals;

(f) calculating a unit filling of the shredded tobacco corresponding to a predetermined length of the tobacco rod in accordance with the detection signals and outputting a calculation result, including the substeps of (f1) integrating the detection signals with respect to time and outputting an integral value, (f2) varying the integral value in proportion to the speed of the tobacco rod, and (f3) calculating a unit filling as a function of the varied integral value; and (g) varying the amount of shredded tobacco fed onto cigarette paper in step (b) in accordance with the unit filling calculated in step (f).

* * * * *